US010415417B2

(12) United States Patent
McCaffrey

(10) Patent No.: US 10,415,417 B2
(45) Date of Patent: Sep. 17, 2019

(54) GAS TURBINE ENGINE ACTIVE CLEARANCE CONTROL SYSTEM

(71) Applicant: United Technologies Corporation, Farmington, CT (US)

(72) Inventor: Michael G. McCaffrey, Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 452 days.

(21) Appl. No.: 15/221,061

(22) Filed: Jul. 27, 2016

(65) Prior Publication Data

US 2018/0030846 A1 Feb. 1, 2018

(51) Int. Cl.

| | |
|---|---|
| ***F01D 11/22*** | (2006.01) |
| ***F01D 11/20*** | (2006.01) |
| ***F01D 25/24*** | (2006.01) |

(52) U.S. Cl.

CPC ..... *F01D 11/22* (2013.01); *F01D 11/20* (2013.01); *F01D 25/24* (2013.01); *F05D 2260/97* (2013.01)

(58) Field of Classification Search

CPC ..... F01D 11/20; F01D 11/22

USPC ..... 415/173.2, 174.1

See application file for complete search history.

(56) References Cited

U.S. PATENT DOCUMENTS

| | | | | | |
|---|---|---|---|---|---|
| 5,018,942 | A * | 5/1991 | Ciokajlo | F01D 11/22 | 415/127 |
| 5,049,033 | A * | 9/1991 | Corsmeier | F01D 11/22 | 415/127 |
| 5,362,202 | A * | 11/1994 | Derouet | F01D 11/22 | 415/148 |
| 7,341,426 | B2 * | 3/2008 | Schwarz | F01D 11/122 | 415/127 |
| 7,625,169 | B2 * | 12/2009 | Manzoori | F01D 11/22 | 415/14 |
| 9,915,162 | B2 * | 3/2018 | Duguay | F01D 11/20 | |

FOREIGN PATENT DOCUMENTS

| | | | | |
|---|---|---|---|---|
| EP | 1676978 | A2 | 7/2006 | |
| GB | 2068470 | A * | 8/1981 | F01D 11/22 |
| GB | 2235732 | A | 3/1991 | |
| GB | 2241024 | A | 8/1991 | |
| WO | 2014186001 | A2 | 11/2014 | |

OTHER PUBLICATIONS

European Search Report for European Application No. 17173094.8 dated Nov. 28, 2017, 7 pages.

* cited by examiner

*Primary Examiner* — Jason D Shanske
*Assistant Examiner* — John S Hunter, Jr.
(74) *Attorney, Agent, or Firm* — Cantor Colburn LLP

(57) ABSTRACT

A gas turbine engine includes a blade having a tip, a blade outer air seal operatively connected to a case assembly, and an active clearance control system disposed on the case assembly. The active control system includes an actuator assembly. The actuator assembly includes a motor assembly and a shaft. The shaft has a shaft body that extends between a first end that is operatively connected to the motor assembly and a second end that is operatively connected to the blade outer air seal.

20 Claims, 4 Drawing Sheets

GAS TURBINE ENGINE ACTIVE CLEARANCE CONTROL SYSTEM

STATEMENT OF FEDERAL SUPPORT

This invention was made with government support under Contract No. FA8650-15-D-2502 awarded by the United States Air Force. The government has certain rights in the invention.

BACKGROUND

The present disclosure relates to gas turbine engine, and more particularly to a gas turbine engine having an active clearance control system.

Gas turbine engines generally include a compressor to pressurize airflow, a combustor to burn a hydrocarbon fuel in the presence of the pressurized airflow, and a turbine to extract energy from the resultant combustion gases. The compressor and the turbine each include rotatable blades and stationary vane arrays. The outermost tips of each rotatable blade are positioned in close proximity to a shroud assembly. A blade outer air seal (BOAS) is supported by the shroud assembly and is configured to adjust a radial tip clearance between the rotatable blades and the BOAS. To facilitate engine performance, it is operationally advantageous to maintain a small radial tip clearance through the various engine operational conditions.

Accordingly, it is desirable to provide a system that is able to adjust the radial tip clearance during engine operation.

BRIEF DESCRIPTION

According to an embodiment of the present disclosure, a gas turbine engine is provided. The gas turbine engine includes a blade having a tip, a blade outer air seal operatively connected to a case assembly, and an active clearance control system disposed on the case assembly. The active control system includes an actuator assembly. The actuator assembly includes a motor assembly and a shaft. The shaft has a shaft body that extends between a first end that is operatively connected to the motor assembly and a second end that is operatively connected to the blade outer air seal.

In addition to one or more of the features described above, or as an alternative, the actuator assembly is at least partially disposed on the case assembly.

In addition to one or more of the features described above, or as an alternative, the actuator assembly is at least partially disposed on a fan duct that is disposed about the case assembly.

In addition to one or more of the features described above, or as an alternative, the shaft is movable between an extended position and a retracted position in response to operation of the motor assembly to adjust a clearance between the tip of the blade and the blade outer air seal.

In addition to one or more of the features described above, or as an alternative, the actuator assembly further comprising a housing through which the shaft at least partially extends, the housing defines a groove having a helix angle.

In addition to one or more of the features described above, or as an alternative, the shaft defines a first tooth that radially extends from the shaft body and is at least partially received within the groove.

In addition to one or more of the features described above, or as an alternative, the first tooth has a complementary helix angle.

According to another embodiment of the present disclosure, an active clearance control system for a gas turbine engine is provided. The active clearance control system includes an actuator assembly that includes a drive motor, a drive gear, a housing, and a shaft. The drive motor is operatively connected to a gear train. The drive motor and the gear train are rotatable about a first axis and are received within an enclosure assembly. The drive gear is drivably connected to the gear train. The drive gear is rotatable about a second axis that is disposed transverse to the first axis and is received within the enclosure assembly. The housing extends from the enclosure assembly along the second axis. The housing has a first housing portion that is joined to a second housing portion. The shaft has a first end that is operatively connected to the drive gear and a second end that is operatively connected to a blade outer air seal. The shaft is configured to move between an extended position and a retracted position along the second axis in response to operation of the drive motor to adjust a clearance between a tip of a blade and the blade outer air seal.

In addition to one or more of the features described above, or as an alternative, the first end of the shaft is operatively connected to the drive gear through a joint assembly.

In addition to one or more of the features described above, or as an alternative, the first housing portion includes a first exterior surface, a first interior first surface disposed opposite the first exterior surface, a first interior second surface disposed opposite the first exterior surface, a first extension surface that extends between respective ends of the first interior first surface and the first interior second surface, and a first end surface that extends between the first exterior surface and the first interior second surface.

In addition to one or more of the features described above, or as an alternative, the second housing portion includes a second exterior first surface, a second exterior second surface that engages the first interior second surface, and a second extension surface that extends between respective ends of the second exterior first surface and the second exterior second surface.

In addition to one or more of the features described above, or as an alternative, the second housing portion includes a second interior surface disposed opposite the second exterior second surface and a second end surface that extends between the second interior surface and the second exterior second surface.

In addition to one or more of the features described above, or as an alternative, the first extension surface, the first interior second surface, and the second end surface define a groove having a helix angle.

In addition to one or more of the features described above, or as an alternative, the shaft includes a first tooth having a complementary helix angle and is at least partially received within the groove.

In addition to one or more of the features described above, or as an alternative, the shaft includes a second tooth having the complementary helix angle, the second tooth being is radially spaced apart from the first tooth and is at least partially received within the groove.

According to yet another embodiment of the present disclosure, an actuator assembly for an active clearance control system is provided. The actuator assembly includes a drive motor that is rotatably connected to a gear train, a drive gear drivably connected to the gear train, and a shaft. The shaft is operatively connected to the drive gear. The shaft is received within a housing that has an interior surface defining a groove. The shaft has a first tooth and a second tooth radially spaced apart from the first tooth. The first tooth and the second tooth are at least partially received within the groove.

In addition to one or more of the features described above, or as an alternative, the shaft is configured to move between an extended position and a retracted position in response to operation of the drive motor to adjust a clearance between a tip of a blade and a blade outer air seal.

In addition to one or more of the features described above, or as an alternative, further embodiments may include an extension shaft that is operatively connected to a first end of the shaft and the drive gear.

In addition to one or more of the features described above, or as an alternative, further embodiments may include a lever that is operatively connected to a second end of the shaft and a blade outer air seal.

In addition to one or more of the features described above, or as an alternative, the shaft is configured to move the lever between a first position and a second position in response to operation of the drive motor to adjust a clearance between a tip of a blade and the blade outer air seal.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Referring now to the Figures, where the present disclosure will be described with reference to specific embodiments, without limiting same, it is to be understood that the disclosed embodiments are merely illustrative and may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
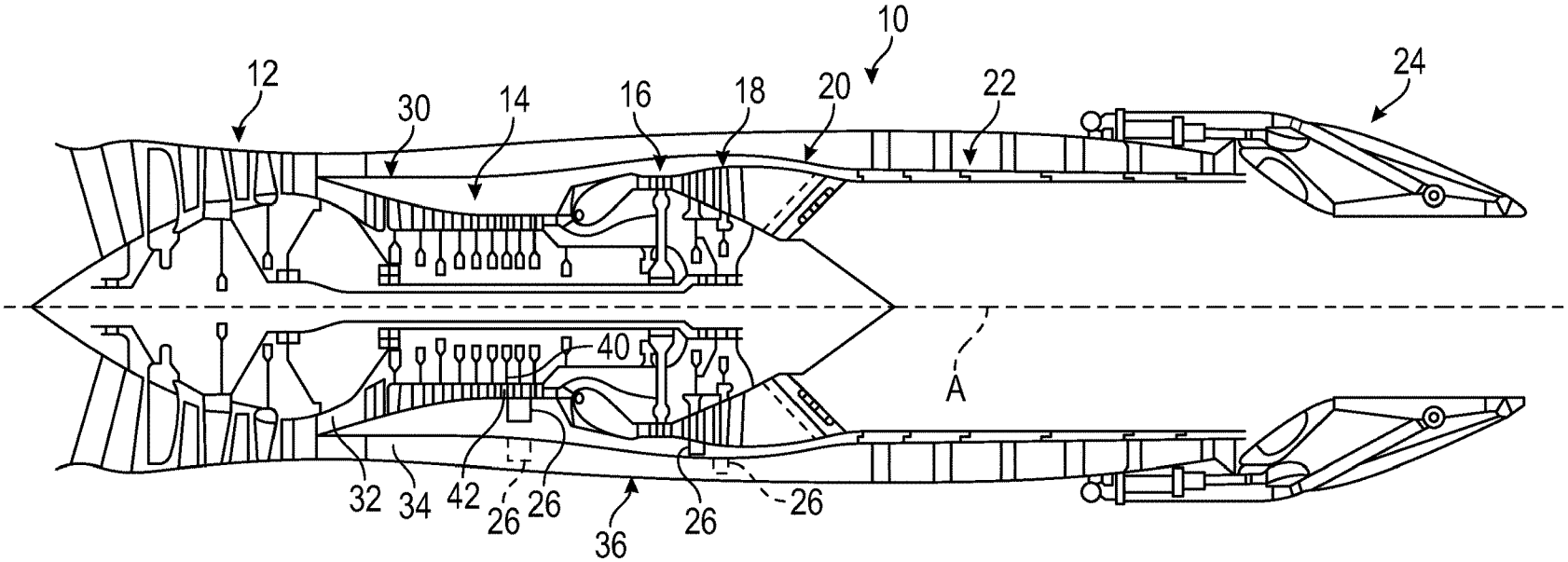
FIG. 1 is a schematic cross-section of a gas turbine engine.

FIG. 1 schematically illustrates a gas turbine engine 10. The gas turbine engine 10 may be configured as a two-spool low-bypass augmented turbofan. Although depicted as an augmented low bypass turbofan in the disclosed non-limiting embodiment, it should be understood that the concepts described herein are applicable to other gas turbine engines including non-augmented engines, geared architecture engines, direct drive turbofans, turbojet, turboshaft, multi-stream variable cycle adaptive engines and other engine architectures. The gas turbine engine 10 includes a fan section 12, a compressor section 14, a combustor section 16, a turbine section 18, an augmenter section 20, an exhaust duct section 22, and a nozzle assembly 24 along a central longitudinal engine axis A, and an active clearance control system 26.

A case assembly 30 is disposed about the compressor section 14, the combustor section 16, the turbine section 18, the augmenter section 20, and the exhaust duct section 22. The case assembly 30 abuts the fan section 12 and extends between the fan section 12 and the nozzle assembly 24. Air that enters the fan section 12 may be divided between a core flow path 32 and a bypass flow path 34. The core flow path 32 flows or extends through the compressor section 14, the combustor section 16, the turbine section 18, and the augmenter section 20. The bypass flow path 34 is defined by an area that is disposed between the case assembly 30 and a fan duct 36 that is disposed about the case assembly 30.

Figure 2:
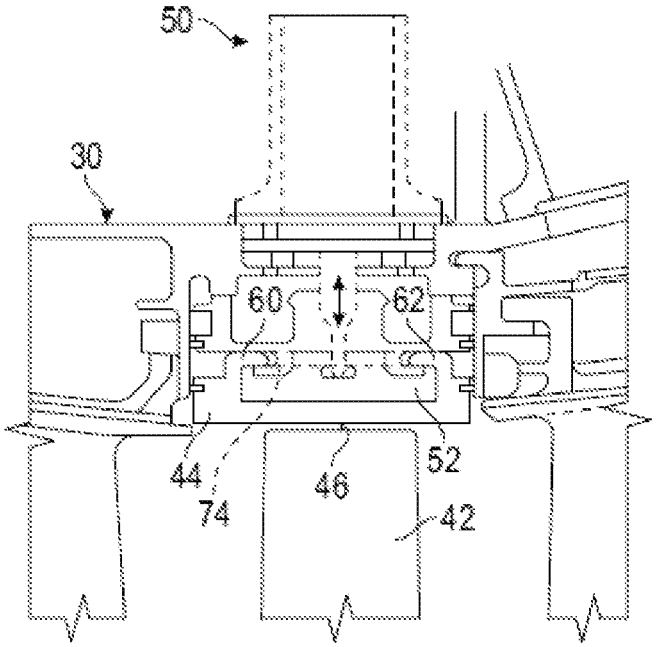
FIG. 2 is a partial perspective view of a portion of an active clearance control system operatively connected to a case assembly of the gas turbine engine.

Referring to FIGS. 1 and 2, each of the compressor section 14 and the turbine section 18 includes a rotor 40 having a blade 42 that radially extends from the rotor 40. The blade 42 extends towards a blade outer air seal 44 that is operatively connected to the case assembly 30. The blade outer air seal 44 is radially adjustable in response to actuation of the active clearance control system 26 to control a clearance 46 between a tip of the blade 42 and the blade outer air seal 44.

The active clearance control system 26 is provided as a portion of a rapid response active clearance control system that is configured to quickly move the blade outer air seal 44. The active clearance control system 26 includes an actuator assembly 50 that is operatively connected to the blade outer air seal 44 through a mounting member 52. The mounting member 52 is operatively connected to the blade outer air seal 44. The blade outer air seal 44 is provided with a first hook 60 and a second hook 62 that is configured to secure the mounting member 52 to the blade outer air seal 44.

Figure 3:
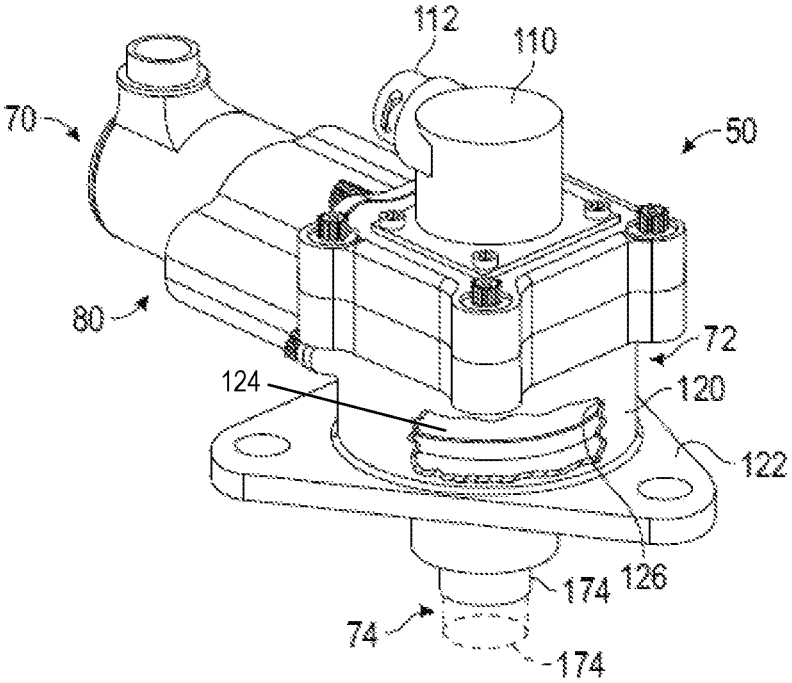
FIG. 3 is a partial perspective view of an actuator of an active clearance control system.
Figure 4:
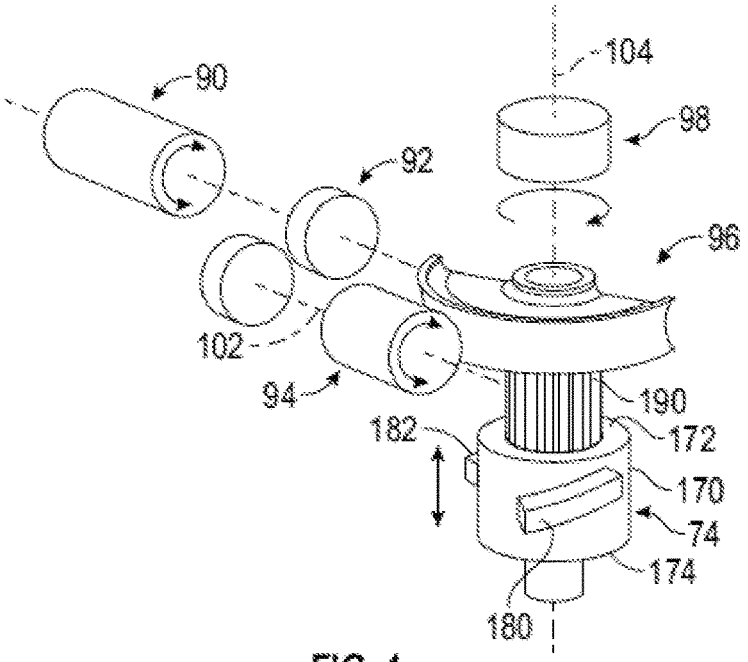
FIG. 4 is a disassembled view of the actuator of the active clearance control system.

Referring to FIGS. 2-4, the actuator assembly 50 is disposed on or is recessed within the case assembly 30 or the fan duct 36. The actuator assembly 50 includes a motor assembly 70, a housing 72, and a shaft 74.

The motor assembly 70 is disposed within an enclosure assembly 80. The motor assembly 70 includes a drive motor 90, a reduction gear assembly 92, a worm gear 94, a drive gear 96, and a position sensor 98.

The drive motor 90 and the reduction gear assembly 92 are each disposed within a first portion of the enclosure assembly 80. The drive motor 90 may be a high speed electric motor. The drive motor 90 is operatively (rotatably) connected to the reduction gear assembly 92 and the reduction gear assembly 92 is operatively (rotatably) connected to the worm gear 94. The drive motor 90, the reduction gear assembly 92, and the worm gear 94 each extend along or are disposed substantially parallel to and are rotatable about a first axis 102. The reduction gear assembly 92 and the worm gear 94 define a gear train.

The worm gear 94 and the drive gear 96 are each disposed within a second portion of the enclosure assembly 80 that extends from the first portion of the enclosure assembly 80. The worm gear 94 is operatively (rotatably) connected to the drive gear 96. The drive gear 96 extends along or is disposed substantially parallel to and is rotatable about a second axis 104. The drive gear 96 is configured as a gear sector such that it is not a full circular gear. As shown in FIG. 4, the drive gear 96 is configured to rotate about the second axis 104 through an angle less than or equal to 90°. The second axis 104 is disposed substantially transverse to the first axis 102. The rotation operation of the drive motor 90 about the first axis 102 rotates the reduction gear assembly 92 about the first axis 102 to rotate the worm gear 94 about the first axis 102 to rotate the drive gear 96 about the second axis 104.

The position sensor 98 faces towards the drive gear 96. The position sensor 98 is configured to provide a signal indicative of a rotational position of the drive gear 96 to a control system. The position sensor 98 is disposed within a sensor housing 110 that is connected to the second portion of the enclosure assembly 80. The sensor housing 110 is disposed opposite the housing 72. The sensor housing 110 extends along the second axis 104. The sensor housing 110 includes a connector 112 that extends along an axis that is spaced apart from and is disposed substantially parallel to the first axis 102.

The housing 72 is operatively connected to the second portion of the enclosure assembly 80. The housing 72 extends from the second portion of the enclosure assembly 80 about and along the second axis 104. The housing 72 includes a wall 120 and a mounting flange 122 extending from the wall 120. The wall 120 includes an interior surface 124 that defines a groove 126 having a helix angle. In at least one embodiment, the groove 126 is configured as two arcs of mating teeth or a trough that define a pair of end stops to inhibit further rotation of the shaft 74 within the housing 72. The end stops permit the shaft 74 to rotate no more than 90° or one quarter of a complete turn.

The mounting flange 122 is spaced apart from the second portion of the enclosure assembly 80. The mounting flange 122 radially extends away from the wall 120 of the housing 72. The mounting flange 122 operatively connects the housing 72 of the actuator assembly 50 to at least one of the case assembly 30 and the fan duct 36.

Figure 5A:
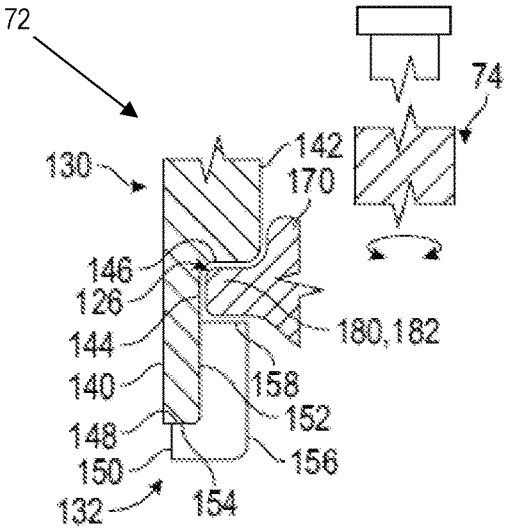
FIG. 5A is a partial sectional view of a portion of a first configuration of a housing of the active clearance control system.

Referring to FIG. 5A, the housing 72 includes a first housing portion 130 that is connected to a second housing portion 132. The first housing portion 130 and the second housing portion 132 segments the housing 72 into two removable pieces. The first housing portion 130 is configured as an integral thrust plate.

The first housing portion 130 extends from the second portion of the enclosure assembly 80 towards the second housing portion 132. The first housing portion 130 includes a first exterior surface 140, a first interior first surface 142, a first interior second surface 144, a first extension surface 146, and a first end surface 148. The first interior first surface 142 is disposed opposite the first exterior surface 140. The first interior second surface 144 is spaced apart from the first interior first surface 142 and is disposed opposite and is disposed substantially parallel to the first exterior surface 140. The first interior second surface 144 is disposed closer to the first exterior surface 140 than the first interior first surface 142. The first extension surface 146 extends between respective ends of the first interior first surface 142 and the first interior second surface 144. The first end surface 148 extends between respective ends of the first exterior surface 140 and the first interior second surface 144.

The second housing portion 132 extends from the first housing portion 130 towards the mounting flange 122. The second housing portion 132 includes a second exterior first surface 150, a second exterior second surface 152, a second extension surface 154, a second interior surface 156, and a second end surface 158. The second exterior first surface 150 is disposed substantially parallel to the first exterior surface 140. The second exterior second surface 152 is spaced apart from the second exterior first surface 150. The second exterior second surface 152 is configured to engage the first interior second surface 144. The second extension surface 154 extends between respective ends of the second exterior first surface 150 and the second exterior second surface 152. The second extension surface 154 is configured to engage the first end surface 148. The second interior surface 156 is disposed opposite the second exterior second surface 152. The second end surface 158 extends between respective ends of the second interior surface 156 and the second exterior second surface 152. The first interior second surface 144, the first extension surface 146, and the second end surface 158 define the groove 126 having the helix angle.

Figure 5B:
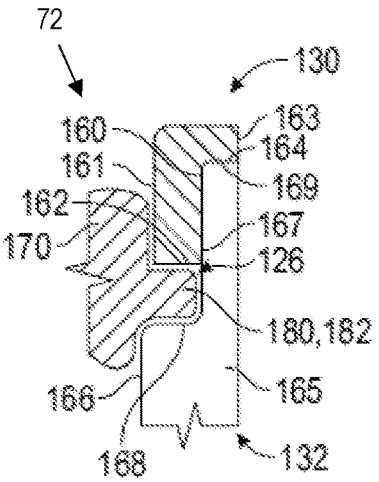
FIG. 5 B is a partial sectional view of a portion of a second configuration of a housing of the active clearance control system.

Referring to FIG. 5B, an alternate configuration of the housing 72 is shown. The first housing portion 130 is configured as a removable thrust plate that is removable from the second housing portions 132. The removable thrust plate may be threaded onto the second housing portion 132, may be bolted onto the second housing portion 132, and the removable thrust plate may be a machined plate provided with a retaining sing or a spiral lock ring. The first housing portion 130 includes a first exterior surface 160, a first interior surface 161, a first end surface 162, a first rim surface 163, and a first extension surface 164. The first interior surface 161 is disposed opposite and is disposed substantially parallel to the first exterior surface 160. The first end surface 162 extends between respective ends of the first exterior surface 160 and the first interior surface 161. The first rim surface 163 is disposed substantially parallel to the first exterior surface 160. The first rim surface 163 is disposed farther from the first interior surface 161 than the first exterior surface 160. The first extension surface 164 extends between respective ends of the first exterior surface 160 and the first rim surface 163.

The second housing portion 132 includes a second exterior surface 165, a second interior first surface 166, a second interior second surface 167, a second extension surface 168, and a second end surface 169. The second interior first surface 166 is disposed opposite and is disposed substantially parallel to the second exterior surface 165. The second interior second surface 167 is spaced apart from the second interior first surface 166 and is disposed opposite and is disposed substantially parallel to the second exterior surface 165. The second interior second surface 167 is configured to engage the first exterior surface 160 of the first housing portion 130. The second interior second surface 167 is disposed closer to the second exterior surface 165 than the second interior first surface 166. The second extension surface 168 extends between respective ends of the second interior first surface 166 and the second interior second surface 167. The second end surface 169 extends between respective ends of the second exterior surface 165 and the second interior second surface 167 and is configured to engage the first extension surface 164 of the first housing portion 130. The first end surface 162, second interior second surface 167, and the second extension surface 168 define the groove 126 having the helix angle.

The configurations of the housing 72 may be selected based on the primary load direction of the actuator assembly 50.

Figure 6:
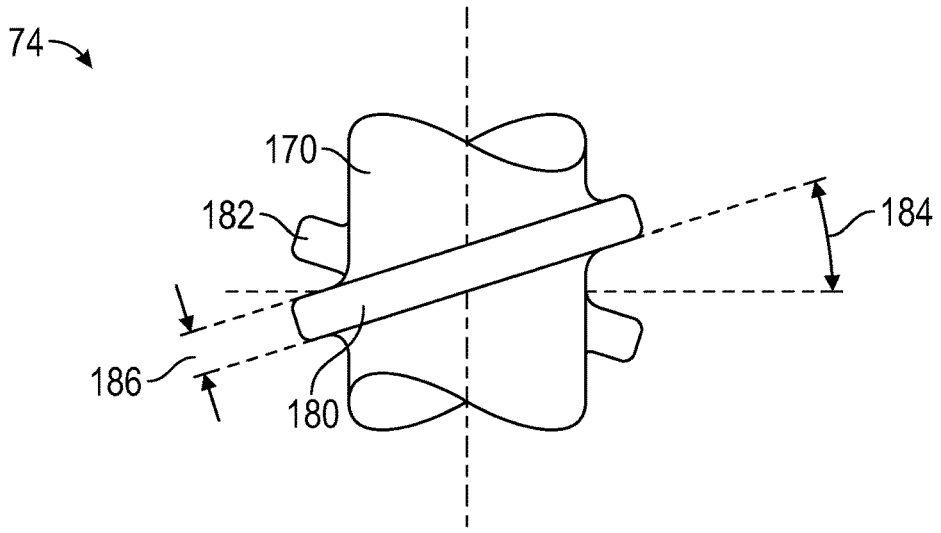
FIG. 6 is a partial perspective view of a shaft of the actuator of the active clearance control system.

Referring to FIGS. 4-6, the shaft 74 extends through the housing 72 towards the blade outer air seal 44. The shaft 74 has a shaft body 170 that extends between a first end 172 and a second end 176.

The shaft body 170 defines a first tooth 180 and a second tooth 182. The first tooth 180 and the second tooth 182 are radially spaced apart from each other such that they are opposed. The first tooth 180 and the second tooth 182 are configured to create a substantial force over a fairly short actuation distance or actuation stroke.

The first tooth 180 radially extends from the shaft body 170 towards the groove 126 of the housing 72. The first tooth 180 is at least partially received within the groove 126. The first tooth 180 is provided with a complementary helix angle 184 that is complementary to the helix angle of the groove 126. The complementary helix angle 184 is a shallow helix having a shallow slope. The shallow helix inhibits or reduces an opportunity to back drive the drive motor 90 of the motor assembly 70. The shallow helix angle also allows the drive motor 90 to provide a very low torque to overcome frictional forces between the first tooth 180 and the groove 126. The first tooth 180 has a tooth thickness 186 that is independent of the pitch of the helix due to the one quarter turn configuration of the shaft 74.

The second tooth 182 radially extends from the shaft body 170 towards the groove 126 of the housing 72. The second tooth 182 is at least partially received within the groove 126. The second tooth 182 is also provided with the complementary helix angle 184 that is complementary to the helix angle of the groove 126. The second tooth 182 also has a tooth thickness 186 that is independent of the pitch of the helix due to the one quarter turn configuration of the shaft 74.

The first end 172 of the shaft 74 is operatively connected to the drive gear 96 of the motor assembly 70 through a joint assembly 190. The joint assembly 190 is configured as a sliding joint having a splined connection that extends at least partially into the first end 172 of the shaft 74. In at least one embodiment, the joint assembly 190 is provided with a bushing or journal bearing that is operatively connected to the drive gear 96.

The second end 174 of the shaft 74 is operatively connected to the blade outer air seal 44. The second end 174 of the shaft 74 is operatively connected to the blade outer air seal 44 through the mounting member 52 as shown in FIG. 2. The second end 174 of the shaft 74 may be engaged with the first hook 60 and the second hook 62 of the blade outer air seal 44.

The shaft 74 is movable between a retracted position as shown in solid in FIG. 3 and an extended position as shown in dashed lines in FIG. 3. The shaft 74 is movable between the retracted position and the extended position along the second axis 104 in response to rotation of the drive gear 96 and the shaft 74 within the housing 72. For example, in response to rotation of the drive gear 96 in a first direction, the shaft 74 strokes to move from the retracted position towards the extended position to move the blade outer air seal 44 towards the tip of the blade 42 to reduce the clearance 46. In response to rotation of the drive gear and a second direction that is disposed opposite the first direction, the shaft 74 moves from the extended position towards the retracted position to move the blade outer air seal 44 away from the tip of the blade 42 to increase the clearance 46.

Figure 7:
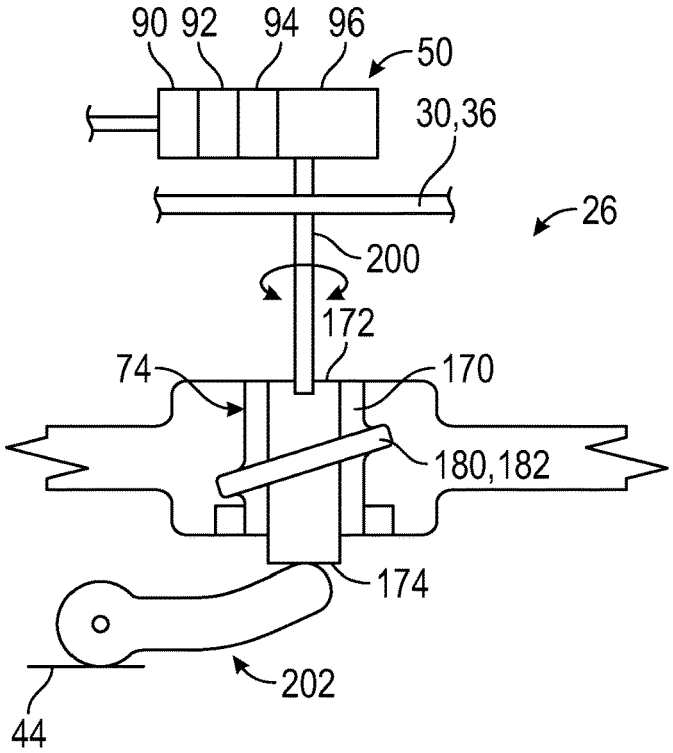
FIG. 7 is a partial perspective view of a remotely located active clearance control system.

Referring to FIG. 7, the actuator assembly 50 of the active control system may be remotely mounted such that the motor assembly 70 is not co-located with the housing 72 and the shaft 74. The motor assembly 70 may be disposed on the fan duct 36 while the housing 72 and the shaft 74 are disposed on or proximate the case assembly 30. The motor assembly 70 is operatively connected to the housing 72 and the shaft 74 by an extension shaft 200 and the shaft 74 is operatively connected to the blade outer air seal 44 by a lever 202.

The extension shaft 200 extends between the drive gear 96 of the motor assembly 70 and the first end 172 of the shaft 74. The extension shaft 200 may extend through at least one of the case assembly 30 and the fan duct 36. The extension shaft 200 is at least partially received within the first end 172 of the shaft 74. The extension shaft 200 is configured to provide a rotational input of the drive gear 96 of the motor assembly 70 to the shaft 74.

The lever 202 is operatively connected to the blade outer air seal 44 and the second end 174 of the shaft 74. The lever 202 is movable between a first position and a second position in response to operation of the drive motor 90 and the subsequent stroking of the shaft 74 between the retracted position in the extended position to adjust the clearance 46 between the tip of the blade 42 and the blade outer air seal 44.

Throughout this specification, the term "attach," "attachment," "connected", "coupled," "coupling," "mount," or "mounting" shall be interpreted to mean that one structural component or element is in some manner connected to or contacts another element—either directly or indirectly through at least one intervening structural element—or is integrally formed with the other structural element.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A gas turbine engine, comprising:

a blade having a blade tip;

a blade outer air seal operatively connected to a case assembly; and an active clearance control system disposed on the case assembly, the active clearance control system comprising:

an actuator assembly having:

a motor assembly, and a shaft having a shaft body extending between a first end that is operatively connected to the motor assembly and a second end that is operatively connected to the blade outer air seal, the shaft configured to translate toward the blade tip thereby moving the blade outer air seal toward the blade tip and the shaft configured to translate away from the blade tip thereby moving the blade outer air seal away from the blade tip.

2. The gas turbine engine of claim 1, wherein the actuator assembly is at least partially disposed on the case assembly.

3. The gas turbine engine of claim 1, wherein the actuator assembly is at least partially disposed on a fan duct that is disposed about the case assembly.

4. The gas turbine engine of claim 1, wherein the shaft is configured to be movable between an extended position and a retracted position in response to operation of the motor assembly to adjust a clearance between the tip of the blade and the blade outer air seal.

5. The gas turbine engine of claim 4, wherein the actuator assembly further comprising a housing through which the shaft at least partially extends, the housing defines a groove.

6. The gas turbine engine of claim 5, wherein the shaft defines a first tooth that radially extends from the shaft body and the first tooth is at least partially received within the groove.

7. The gas turbine engine of claim 6, wherein the first tooth has a complementary helix angle.

8. An active clearance control system for a gas turbine engine, comprising:

an actuator assembly having:

a drive motor operatively connected to a gear train, the drive motor and the gear train being rotatable about a first axis and received within an enclosure assembly;

a drive gear drivably connected to the gear train, the drive gear being rotatable about a second axis that is disposed transverse to the first axis and received within the enclosure assembly;

a housing extending from the enclosure assembly along the second axis, the housing having a first housing portion joined to a second housing portion; and a shaft having a first end operatively connected to the drive gear and a second end operatively connected to a blade outer air seal, the shaft being configured to move between an extended position and a retracted position along the second axis in response to operation of the drive motor to adjust a clearance between a tip of a blade and the blade outer air seal, the shaft configured such that when moving to the extended position the second end moves away from the housing along the second axis and when moving to the retracted position the second end moves toward the housing along the second axis.

9. The active clearance control system of claim 8, wherein the first end of the shaft is operatively connected to the drive gear through a joint assembly.

10. The active clearance control system of claim 8, wherein the first housing portion includes a first exterior surface, a first interior first surface disposed opposite the first exterior surface, a first interior second surface disposed opposite the first exterior surface, a first extension surface that extends between respective ends of the first interior first surface and the first interior second surface, and a first end surface that extends between the first exterior surface and the first interior second surface.

11. The active clearance control system of claim 10, wherein the second housing portion includes a second exterior first surface, a second exterior second surface that engages the first interior second surface, and a second extension surface that extends between respective ends of the second exterior first surface and the second exterior second surface.

12. The active clearance control system of claim 11, wherein the second housing portion includes a second interior surface disposed opposite the second exterior second surface and a second end surface that extends between the second interior surface and the second exterior second surface.

13. The active clearance control system of claim 12, wherein the first extension surface, the first interior second surface, and the second end surface define a groove.

14. The active clearance control system of claim 13, wherein the shaft includes a first tooth having a complementary helix angle and is at least partially received within the groove.

15. The active clearance control system of claim 14, wherein the shaft includes a second tooth having the complementary helix angle, the second tooth being is radially spaced apart from the first tooth and is at least partially received within the groove.

16. An actuator assembly for an active clearance control system, comprising:

a drive motor rotatably connected to a gear train;

a drive gear drivably connected to the gear train; and a shaft being operatively connected to the drive gear, the shaft received within a housing having an interior surface defining a groove, the shaft having a first tooth and a second tooth radially spaced apart from the first tooth, the first tooth and the second tooth being at least partially received within the groove, the shaft having a first end and a second end, the first end nearer to the drive motor that the second end, the shaft configured such that a when moving toward an extended position the second end moves away from the drive motor and when moving toward a retracted position the second end moves toward the drive motor.

17. The actuator assembly of claim 16, wherein the shaft is configured to move between the extended position and the retracted position in response to operation of the drive motor to adjust a clearance between a tip of a blade and a blade outer air seal.

18. The actuator assembly of claim 16, further comprising an extension shaft that is operatively connected to the first end of the shaft and the drive gear.

19. The actuator assembly of claim 18, further comprising a lever that is operatively connected to the second end of the shaft and a blade outer air seal.

20. The actuator assembly of claim 19, wherein the shaft is configured to move the lever between a first position and a second position in response to operation of the drive motor to adjust a clearance between a tip of a blade and the blade outer air seal.

* * * * *